US006464190B1

(12) United States Patent
Aramaki

(10) Patent No.: US 6,464,190 B1
(45) **Date of Patent: *Oct. 15, 2002**

(54) SELF-WINDING-TYPE FIXTURE-LIFTING/LOWERING DEVICE

(75) Inventor: Noriyoshi Aramaki, Kawaguchi (JP)

(73) Assignee: Aramaki Technica Co., Ltd., Saitama (JP)

( * ) Notice: Subject to any disclaimer, the term of this patent is extended or adjusted under 35 U.S.C. 154(b) by 60 days.

This patent is subject to a terminal disclaimer.

(21) Appl. No.: 09/705,813

(22) Filed: Nov. 6, 2000

(30) Foreign Application Priority Data

Nov. 10, 1999 (JP) ..... H11-008588

(51) Int. Cl.[7] ..... A47H 1/10
(52) U.S. Cl. ..... 248/327; 248/328
(58) Field of Search ..... 248/317, 320, 248/327, 328, 329, 332, 330.1; 362/386, 402, 403, 404, 405, 453, 250

(56) References Cited

U.S. PATENT DOCUMENTS 2,609,170 A * 9/1952 Farrington et al. ..... 318/466
3,805,054 A * 4/1974 Wolf ..... 248/320 X
4,115,845 A * 9/1978 Blahut ..... 362/403
4,198,022 A * 4/1980 Pletcher et al. ..... 248/320
4,430,694 A * 2/1984 Koivumaki et al. ..... 362/250
4,851,980 A * 7/1989 McWilliams et al. ..... 362/403
5,529,274 A * 6/1996 Anderson et al. ..... 248/329
5,556,195 A * 9/1996 Glebe ..... 248/328 X
5,975,726 A * 11/1999 Latimer ..... 362/384
6,142,439 A * 11/2000 Aramaki ..... 248/327

* cited by examiner

*Primary Examiner*—Leslie A. Braun
*Assistant Examiner*—Tan Le
(74) *Attorney, Agent, or Firm*—Lowe Hauptman Gilman & Berner, LLP

(57) ABSTRACT

A self-winding-type fixture-lifting/lowering device comprising a secure block fitted at an elevated position, and a lifting/lowering block that carries a fixture to be installed at an elevated position and that hangs from the secure block by a pair of wire cables in such a manner as to move upwards and downwards, with the lifting/lowering block including an electric motor for lifting operation and a battery for supplying electric power to the electric motor. When the lifting/lowering block reaches the uppermost position, it is kept in position by a lock mechanism, but it can move downwards by its own weight by rotating the electric motor in the reverse direction when the locked feature of the lock mechanism is released.

18 Claims, 5 Drawing Sheets

SELF-WINDING-TYPE FIXTURE-LIFTING/LOWERING DEVICE

BACKGROUND OF THE INVENTION

1. Field of the Invention

The present invention relates to a self-winding-type of device for raising and lowering various types of fixtures, such as lighting fixtures or public-address speaker systems to be installed above the ground at an outdoor field, above the floor in a room, or on the ceiling of a room.

2. Related Prior Art

Up to now, when various types of fixtures such as streetlights are to be installed at a raised position, or when such fixtures that have been installed at a raised position require maintenance, generally one of the following three procedures is used: (1) a scaffold is provided; (2) a vehicle designed for working at an elevated position is used; or (3) a lift for maintenance work at a raised position is provided.

In the case of a fluorescent-lighting fixture that is installed on a ceiling, for example, a bracket member on the fluorescent-lighting fixture is fixed at the desired position on the ceiling by a fitting means such as fitting screws, and then the main body of the fluorescent-lighting fixture is secured to the bracket member by such fitting means.

However, in such fitting procedures as described above, it is necessary for the fixture to be lifted to an elevated position, and for one or more workers to get to that elevated position by using a raised-position working vehicle. Especially when a lifting device for maintenance work is installed according to the procedure as in item (3) above, there is a problem that, if the lift device itself experiences any trouble or malfunction, it is necessary to build a scaffold as in item (1) or to use an elevated-position work vehicle as in item (2).

Therefore, it is a primary object of the present invention to provide a self-winding-type lifting device that can simplify the work of installing fixtures at an elevated position, and that also makes it possible to carry out maintenance work on such a fixture at a low position by lowering the fixture.

SUMMARY OF THE INVENTION

The present invention provides for a self-winding-type fixture-lifting/lowering device to be used for installing fixtures at an elevated position and to be movable upward and downward, with said device comprising:

(1) a secure block securely fitted to the elevated position;

(2) a lifting/lowering block that (a) hangs from said secure block by a pair of wire cables in a manner so as to be movable upward and downward, that supports the aforementioned fixture, and (b) carries a pair of winding drums for winding and unwinding, respectively, the wire cables referred to below, an electric motor for driving the winding drums synchronously with each other, and a battery for supplying electric power to said electric motor;

such that each of said wire cables is secured to the lifting/lowering block at one end and connected to the winding drums and arranged so as to pass through a path formed on (a) a first pulley that is fixed to the secure block, (b) a second pulley that is disposed apart from the first pulley and fixed to the secure block, and (c) a third pulley that is fixed to the lifting/lowering block;

(3) a lock mechanism for locking the lifting/lowering block against the secure block at the uppermost position thereof; and (4) a release mechanism to release the lock mechanism when the lifting/lowering block is to be moved downwards.

Preferably, the secure block comprises an upper framework of substantially rectangular shape, and the lifting/lowering block comprises a lower framework of substantially rectangular shape, with (a) one end of each of the aforementioned wire cables being secured at a fixing spot disposed at a corner portion of the lower framework, (b) each of the third pulleys being positioned apart from the fixing spot in the widthwise direction of the lower framework, and (c) the first and second pulleys being positioned at points corresponding to the fixing spot and the third pulleys.

The electric motor can be one that can rotate in the direction designed to wind the wire cables when electric power is supplied, and that can rotate in the reverse direction when electric power is not supplied.

Furthermore, the self-winding-type fixture-lifting/lowering device can include a reduction mechanism inserted between the driving shaft of the electric motor and the winding drums.

Preferably, the lock mechanism comprises at least (1) one engaging member that is fixed to the secure block so as to be swingable around a substantially horizontal axis and urged to rotate toward one end of the movable range thereof, and that has at least one engaging hole, (2) at least one hook member to be engaged with the engaging hole of the engaging member and fixed to the lifting/lowering block, and (3) a lock-releasing mechanism for releasing the engagement between the engaging member and the hook member by rotating the engaging member.

Alternatively, the lock-releasing mechanism comprises a lever that is swingably fixed to the secure block and that disengages the locking member from the hook-member engaging member by rotating the engaging member manually.

Another preferable lock-releasing mechanism comprises a solenoid-plunger mechanism for disengaging the engaging member from the hook member when said solenoid-plunger mechanism is supplied with electricity.

A further lock-releasing mechanism can comprise a spring member made of a shape-memory alloy that normally keeps the engaging member in the locked position, and that releases the engaging member from the locked position when said spring member is heated above a specified temperature.

With the present invention, the fixture to be installed at an elevated position can be either a chandelier or a lighting fixture that is to be installed on the ceiling.

Examples of the types of fixtures to be installed at an elevated position by the self-winding-type fixture-lifting/lowering device of the present invention include box-type lighting fixtures, ball-type lighting fixtures, and traffic-signal devices.

In this specification, the term "elevated position" is used to mean a position above the height that the hands of a typical worker standing on the floor can reach. For example, such an elevated position can be the ceiling of a room; the upper part of the inside or outside wall of an ordinary building, a large-size building such as a dome-type space, or an arena; a multipurpose hall; or the upper part of a street light pole or of a tower of various types—on all of which it is very difficult or not easy to install fixtures or to conduct maintenance thereon.

The self-winding-type fixture-lifting/lowering device of the present invention is suitable especially for installing fixtures or the components thereof, such as the lamps used in lighting fixtures, because the lamps used in such applications have a relatively short working life and it is necessary to change broken or worn-out lamps relatively frequently. However, the self-winding-type fixture-lifting/lowering device of the present invention can be applied to every type of fixture that is installed at an elevated position, and it offers such benefits as the fact that maintenance work can be performed on such fixtures easily and safely. Examples of fixtures other then lighting fixtures include public-address speaker systems, monitoring cameras, and image monitors. That is, the present invention is not limited to installing only elevated-position light fixtures.

A BRIEF DESCRIPTION OF THE DRAWINGS

A DESCRIPTION OF THE PREFERRED EMBODIMENT

The present invention will be explained by the following detailed description, which includes references to the attached drawings.

Figure 1:
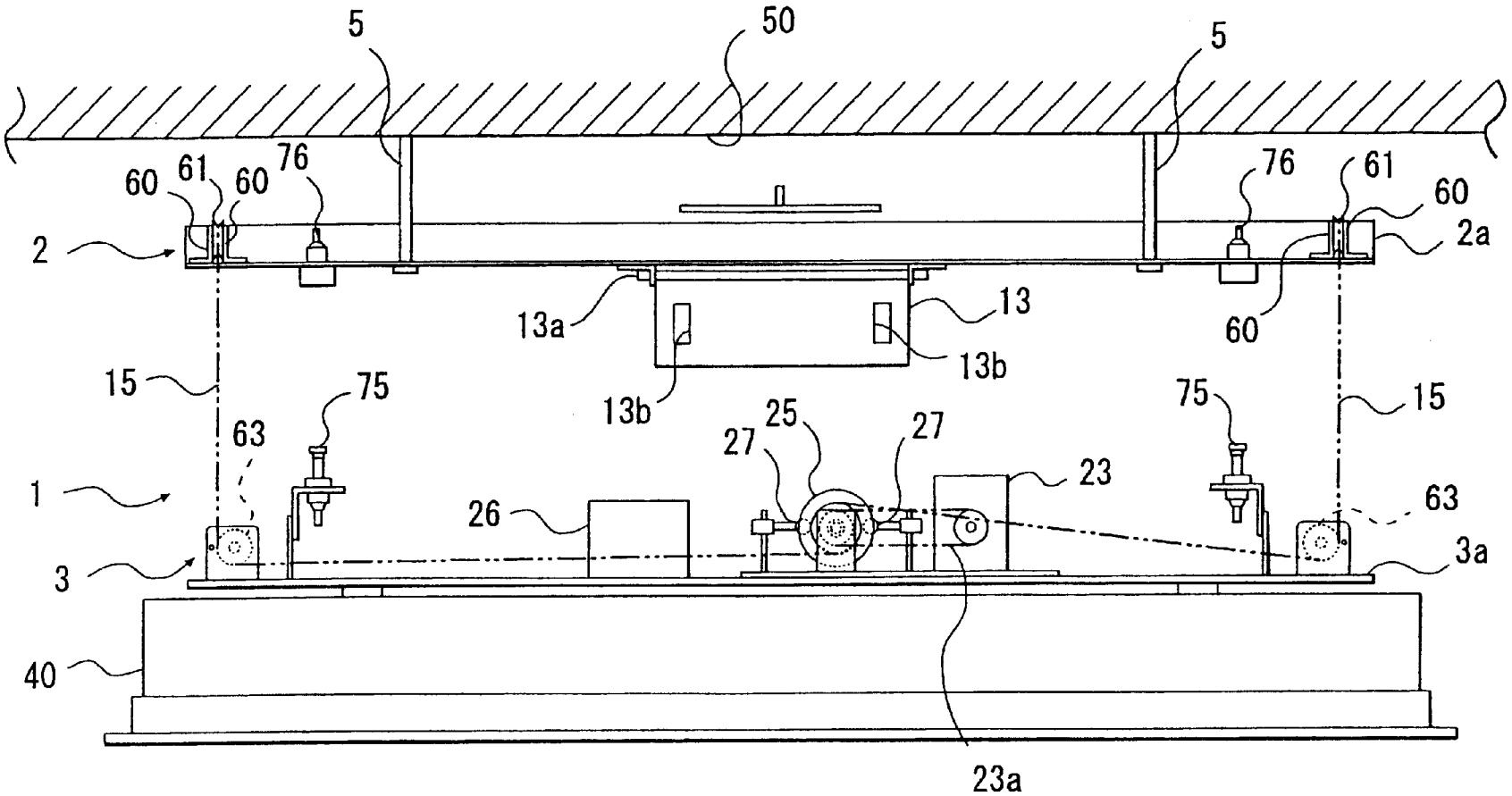
FIG. 1 shows a front view of the self-winding-type fixture-lifting/lowering device embodying the present invention.
Figure 2:
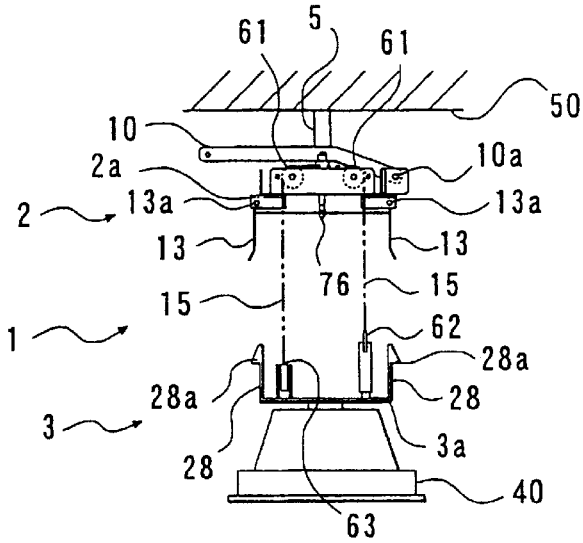
FIG. 2 shows a side view of the self-winding-type fixture-lifting/lowering device.

As illustrated in FIGS. 1 and 2, a self-winding-type fixture-lifting/lowering device 1 embodying the present invention comprises a secure block 2 that is securely fixed at an elevated position such as to a ceiling 50, and a lifting/lowering block 3 that hangs from said secure block 2 by means of a pair of wire cables 15 and that is equipped with an elevated-position fixture 40.

In more detail, the secure block 2 includes an upper framework 2*a* that comprises a plate of an approximately rectangular configuration arranged in a horizontal direction, to which a plurality of rod-like supporting members 5 extend upwards. The upper ends of the supporting members 5 are securely fixed to the ceiling 50.

The lifting/lowering block 3 has a lower framework 3*a* that comprises a plate of an approximately rectangular configuration arranged in a horizontal direction. On the upper surface of the lower framework 3*a* is fixed a drive mechanism for causing the lifting/lowering block 3 to rise and fall. The drive mechanism comprises an electric motor 23, a battery for supplying an electrical force to the electric motor 23 through lead wires 26*a*, and a pair of winding drums 25 that are connected to a rotating shaft of the electric motor 23 via a transmitting chain 23*a* for winding and unwinding, respectively, the wire cables 15. The winding drums 25 are fixed to a common shaft that extends along the widthwise direction thereof toward both ends. Preferably, a reduction device is inserted between the rotary shaft of the electric motor 23 and the shaft so that the winding drums 25 are supported, in order that the driving force can be transmitted to the winding drums 25 with a reduced rotational speed.

Furthermore, on the upper surface of the lower framework 3*a* are provided a pair of guide means 27 for enabling the wire cables 15 to be wound in an orderly manner on their respective winding drums 25. Preferably, each of the guide means 27 has a columnar or tubular configuration, and it functions so as to press the wire cables 15 onto the outermost layer of the cables as they are being wound on the winding drums 25, thereby to wind the wire cables 15 in an orderly manner.

Figure 3:
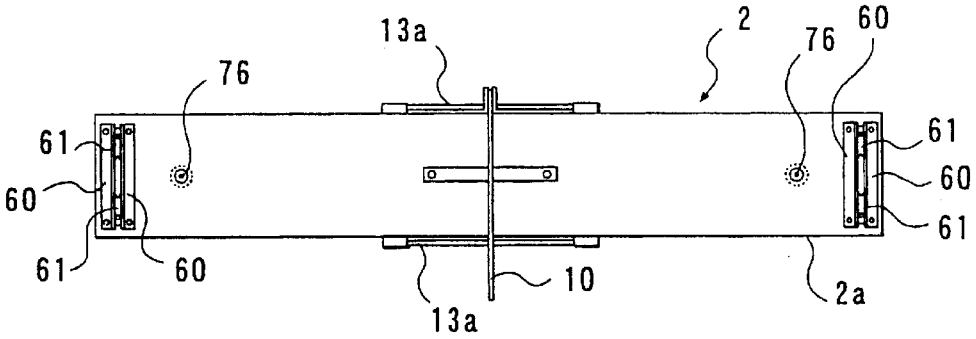
FIG. 3 shows said device's upper framework and elements fixed to that upper framework.

Next, the path of each of the wire cables 15 is described. First, the use of one of the wire cables 15 for lifting one side of the lifting/lowering block 3 will be described. As shown in FIG. 3, at one side in the longitudinal direction of the upper framework 2*a* of the secure block 2, a pair of pulleys 61 for guiding one of the wire cables 15 are rotatably supported around their axes and arranged apart from each other in the widthwise direction of the upper framework 2*a* by a pair of brackets 60, with the peripheral surfaces of the pulleys 61 being apart from each other with an appropriate distance between them. These pulleys 61 act so as to stabilize the posture of both the lifting/lowering block 3 and the elevated-position fixture 40 in a hanged state by the wire cables 15.

Figure 4:
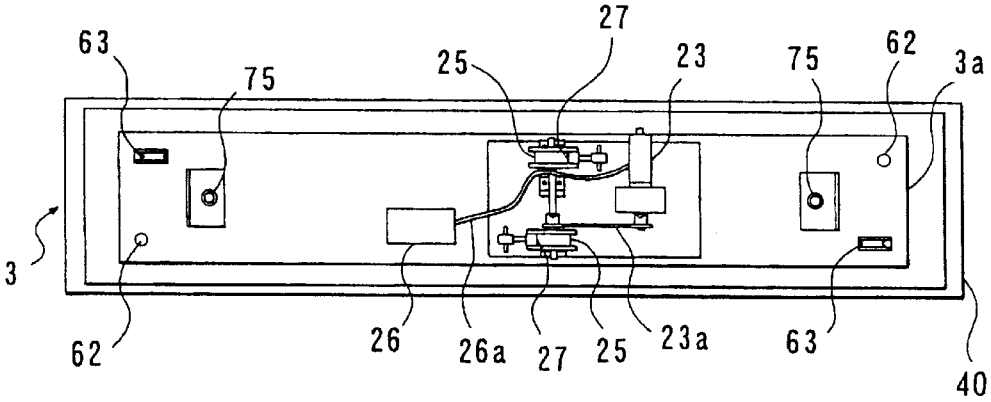
FIG. 4 shows said device's lower framework and elements fixed to that lower framework.

Furthermore, as shown in FIG. 4, on the upper surface of the lower framework 3*a* of the lifting/lowering block 3 and at portions apart form each other in the widthwise direction of the lower framework 3*a*, there are provided a pulley 63 to be engaged with one of the wire cables 15 and a wire-cable fixing spot 62 for securely fixing one end of the wire cables 15. Here, the pulley 63 and the wire-cable fixing spot 62 are disposed apart from each other in the same distance that exists between the pulleys 61. This also helps to promote the stability of the posture of the lifting/lowering block 3 and the elevated-position fixture 40 in a hanged state by the wire cables 15.

Thus, as indicated by the dotted lines in FIGS. 1 and 2, one of the wire cables 15 is arranged along a path that starts from the wire-cable fixing spot 62 (not shown in FIG. 1), to which one end of the wire cable 15 is securely connected, that extends over the pulleys 61 that are fixed to the lower framework 3*a* of the lifting/lowering block 3 and over the pulley 63, and that then reaches one of the winding drums 25 (not shown in FIG. 2) so that the other end of the wire cable 15 is connected to said the winding drum 25.

The other wire cable 15 for lifting the opposite side of the lifting/lowering block 3 and the elements for guiding and driving the wire cable 15 are provided symmetrically with those provided for the former wire cable 15 mentioned above. Namely, for the latter wire cable 15, a pair of pulleys 61, a pulley 63, and a cable-wire fixing spot 62 are provided symmetrically with those provided for the former wire cables 15. Also, the other end of the latter wire cable 15 is securely connected to another winding drum 25.

Due to the arrangement of the wire cables 15, when the winding drums 25 are driven by the electric motor 23 to rotate, both the wire cables 15 are wound on the winding drums 25 in synchronization with each other, thereby to lift up the lifting/lowering block 3 at four points, i.e., two cable-wire fixing spots 62 and two pulleys 63, and to move said lifting/lowering block 3 toward the secure block 2 while maintaining the initial posture of the lifting/lowering block 3 relative to the secure block 2.

In order to hold the lifting/lowering block 3 at the uppermost position, a lock mechanism as better shown in FIGS. 2 and 3 is provided. The lock mechanism comprises at least one pair of (two pairs in this embodiment) hook members 28 (not shown in FIG. 3) that face each other at the central portions of the longitudinal side surfaces of the lower framework 3*a* of the lifting/lowering block 3, and at least one (a pair in this embodiment) engaging member 13 supported by the upper framework 2*a* of the secure block 2 at the position corresponding to the hook members 28 so as to extend downwards. Each of the engaging members 13 is swingably supported by an axle 13*a* that extends parallel to the longitudinal direction of the upper framework 2*a* and that is guided by a coil spring (not shown) so as to rotate in the direction toward the other engaging member 13. Also, the engaging member 13 has a pair of engaging holes 13*b* (not shown in FIG. 3) (see FIG. 1) into which the head portions 28*a* of the corresponding hook members 28 are inserted. For the sake of simplicity, the hook members 28 are not shown in FIGS. 1 and 3.

Engagement of the hook members 28 with the engaging members 13 is accomplished at the end of the upward movement of the lifting/lowering block 3. That is, in the course of the lifting movement of the lifting/lowering block 3, when the lifting/lowering block 3 approaches the uppermost position of its range of movement, the hook members 28 contact the inner surface of the corresponding engaging members 13 to rotate forcibly outwards against the aforementioned urging force acting thereto. When the lifting/lowering block 3 moves upwards to a position such that the hook members 28 face the corresponding engaging holes 13*b*, the engaging members 13 are permitted to rotate toward each other, thereby to achieve the engagement between the hook members 28 and the engaging members 13.

The operation of the electric motor 23 starts when a switch for lifting (not shown) that is provided on the lifting/lowering block 3 is turned to the "ON" position so as to supply electric power from the battery 26 to the electric motor 23. The lifting/lowering block 3 is provided with a limiter mechanism (not shown) that acts to stop the electric motor 23 at the moment when the elevated-position fixture 40 reaches the ceiling 50 during the setting operation mentioned later, without it being necessary for the aforementioned switch for lifting to be turned to the "OFF" position. The operation of the limiter stops the winding operation of the wire cables 15 onto the winding drums 25, thereby stopping the upward movement of the lifting/lowering block 3.

The state in which the hook members 28 are engaged with the engaging members 13 and in which the lifting/lowering block 3 is securely held to the secure block 2 corresponds to the state in which the elevated-position fixture 40 is set at its correct position. In this embodiment, that state is such that the elevated-position fixture 40 is set at the correct position of the ceiling 50.

In order to allow the lowering of the elevated-position fixture 40 for the purpose of maintenance or the like, there is provided a release lever 10 on the secure block 2 for releasing the engagement between the engaging members 13 and the hook members 28. The release lever 10 is provided swingably around a pivot 10*a*. Between the release lever 10 and the engaging members 13 is provided an interlocking mechanism (not shown) that, by using an appropriate tool to pull down the free end of the release lever 10, rotates the release lever 10 in a counter-clock direction (in FIG. 2) so as to enable the engaging members 13 to rotate against the aforementioned urging force acting thereto. Such an interlocking mechanism can easily be provided by one skilled in this art using well-known mechanical elements such as a lever mechanism, a gear assembly, or a wire mechanism, and therefore a detailed description of such a mechanism is omitted here.

Rotation of the engaging members 13 in the direction apart from each other by rotation of the release lever 10 will cause release of the engagement between the engaging holes 13*b* and the hook members 28, and then the lifting/lowering block 3 hangs from the secure block 2 by a pair of wire cables 15, as stated above. In this hanging state, the weight of the lifting/lowering block 3 is transmitted to the winding drums 25, and then to the electric motor 23, thereby causing the rotary shaft of the electric motor 23 to rotate in the unwinding direction. If the electric motor 23 is of a one-direction rotating type having no brake mechanism, the rotary shaft of the electric motor 23 is forcibly rotated in the reverse direction, allowing the downwards movement of the lifting/lowering block 3.

The secure block 2 is provided with a pair of contact members 76 and the lifting/lowering block 3 is provided with another pair of contact members 75. The contact members 75 can electrically contact with the corresponding pair of contact members 76 when the lifting/lowering block 3 is in a locked position, at which time electric power that is supplied to the contact members 76 from a commercial electric power source through wiring (not shown) is transmitted via the contact members 75 to the elevated-position fixture 40 such as a lighting fixture. At the same time, electric power is supplied through the contact members 75 to the battery 26 that is provided for supplying electric power to the electric motor 23 when the lifting/lowering block 3 is not in the fitted position.

Next, the installation of the elevated-position fixture 40 using the self-winding-type fixture-lifting/lowering device 1 will be described.

First, the secure block 2 is securely fitted to the ceiling 50, with the lifting/lowering block 3 and the elevated-position fixture 40 hanging from the secure block 2 by the wire cables 15. At the same time, electric wiring is connected from the commercial power source to the contact members 76.

Then the electric motor 23 is driven to start the winding of the wire cables 15 onto the winding drums 25, thereby to lift the lifting/lowering block 3 toward the secure block 2.

Soon thereafter, the hook members 28 move between the engaging members 13 so as to engage the hook members 28 with the engaging members 13, and the lifting/lowering block 3 is fixed to the secure block 2.

When the engagement between the hook members 28 and the engaging members 13 has been completed, the electric motor 23 is stopped by the operation of the limiter mechanism (not shown), resulting in the stopping of both the winding operation of the winding drums 25 and the upward movement of the lifting/lowering block 3.

At the same time, the lifting/lowering block 3 is locked against the secure block 2 by the aforementioned lock mechanism, and in this state the contact members 76 of the secure block 2 and the contact members 75 of the lifting/lowering block 3 contact each other so as to form an electrically conductive condition that is capable of supplying electric power to the elevated-position fixture 40. At this stage, the installation of the elevated-position fixture 40 has been completed.

If, during the operation of the elevated-position fixture 40, it becomes necessary to lower that fixture 40 for a periodic inspection, to check a malfunction of that fixture, to replace the lamp of that fixture, or to conduct other maintenance work, the release lever 10 is rotated by a worker so as to release the engagement between the engaging members 13 of the secure block 2 and the hook members 28 of the lifting/lowering block 3. By this operation, as has been stated above, the weight of the lifting/lowering block 3 rotates the winding drums 25 and the electric motor 23 connected thereto in the reverse direction through the wire cables 15, resulting in the lowering of the lifting/lowering block 3. The lowering movement will continue until the wire cables 15 that are wound on the winding drums 25 have been completely unwound.

If a reduction mechanism having a suitable reduction rate is provided between the electric motor 23 and the winding drums 25, the descending speed of the lifting/lowering block 3 is reduced by resistance in accordance with the specified reduction rate.

The length of the wire cables 15 determines the lowest position of the range of movement of the lifting/lowering block 3. Therefore, it is possible to determine the height of the lifting/lowering block 3 at the optimum position of the lifting/lowering block 3 for performing maintenance work.

After all of the necessary work has been completed, the electric motor 23 is again driven to wind the wire cables 15 on the winding drums 25 until the lifting/lowering block 3 is lifted to its specified position and is locked in that position.

It should be understood that the present invention can be changed or altered without deviating from its intended purpose. For example, with regard to the aforementioned lock mechanism, hook members 28 can be provided on the upper framework 2*a* and engaging members 13 can be provided on the lower framework 3*a*. Alternatively, it is possible to use a gear train or a transmission belt in place of the transmission chain 23*a* as a device for transmitting the rotation of the electric motor 23 to the winding drums 25.

As another alternative, the release operation of the lock mechanism can be accomplished by using, in place of manually causing the rotating operation of the release lever 10, a solenoid-plunger mechanism that, when actuated by an electric current, acts to release the hook members 28 from the engaging members 13. Or, the aforementioned lock mechanism can comprise a locking member for locking the lifting/lowering block 3 against the secure block 2 and a spring member made of a shape-memory alloy that normally is connected to the locking member so as to keep it in the locking position, but that can release the locking member from the locking position when heated above a specified temperature. Details of such a mechanism will be clear to one skilled in the art relating thereto, and therefore the description thereof is omitted here.

In the foregoing specific embodiment, an electric motor having no brake is used, in order to allow the lifting/lowering block 3 to descend as a result of its weight, but an electric motor having a brake can be used if the brake is released during the downward movement of the lifting/lowering block 3.

Figure 5:
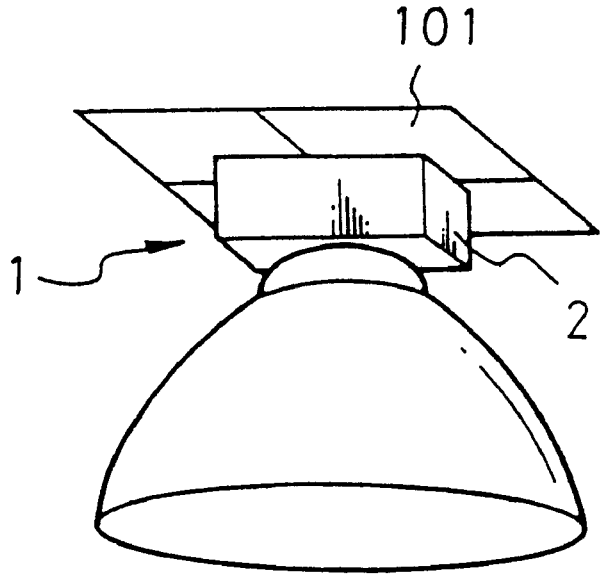
FIG. 5 shows a ceiling-type lighting fixture that can be attached to the ceiling by using an embodiment of the self-winding-type fixture-lifting/lowering device of the present invention.

Examples of the elevated-position fixtures to be installed by using the self-winding-type fixture-lifting/lowering device include, in addition to the aforementioned fluorescent lighting device, various other kinds of ceiling devices. For example, FIG. 5 illustrates another type of lighting fixture attached to a ceiling. In FIG. 5, there are shown a self-winding-type fixture-lifting/lowering device 1 that embodies the present invention, a secure block 2, a ceiling 101, and a lighting fixture 102 of relatively small size to be fixed to the secure block 2. The construction of the self-winding-type fixture-lifting/lowering device 1 is the same as those shown in FIGS. 1 to 4, except for the size.

In this embodiment, the secure block 2 of the self-winding-type fixture-lifting/lowering device 1 is fitted to the ceiling in a room, and the lighting fixture 102 is secured to the lifting/lowering block 3 that hangs from the secure lock 2 by the wire cables 15.

When installing a lighting fixture 102 at a predetermined elevated position, the only work that is necessary at the elevated position is to fit the lightweight upper framework 2*a* of the secure block 2. The lighting fixture 102 can be fitted to the lower surface of the lifting/lowering block on the floor or on a working table or the like, and the lighting fixture 102 can then be set at the predetermined position on the ceiling 101. Therefore, the necessary installation work can be done with great ease. Furthermore, after the lighting fixture 102 has been installed, work associated with periodic inspections or maintenance upon the occurrence of a malfunction of the lighting fixture 102 can be done with ease and in safety, with the lighting fixture 102 on the floor or on a working table or the like.

Figure 6:
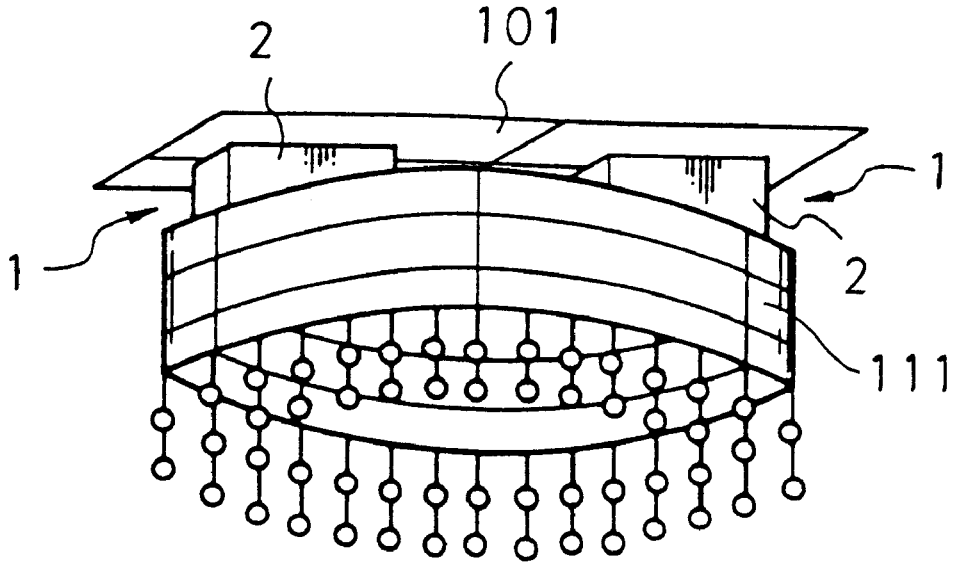
FIG. 6 shows a chandelier that can be attached to the ceiling by using an embodiment of the self-winding-type fixture-lifting/lowering device of the present invention.

FIG. 6 illustrates a chandelier 111 fixed to a ceiling 101 by using a self-winding-type fixture-lifting/lowering device 1 that embodies the present invention. In this embodiment, because of the large size of the chandelier 111, two self-winding-type fixture-lifting/lowering devices 1 are used.

The two self-winding-type fixture-lifting/lowering devices 1 have the same specifications, and they are used in coordinated combination so as to hang the chandelier 111 at positions such that the two self-winding-type fixture-lifting/lowering devices 1 equally share the weight of the chandelier. Therefore, when the chandelier 111 is lowered, the lock mechanisms of the two self-winding-type fixture-lifting/lowering devices 1 are released at the same time, and when the chandelier 111 is lifted to be fixed to its normal position on the ceiling 101, the electric motors 23 rotate the winding drums 25 in synchronization at the same rotational speed. As long as such coordination is maintained, the chandelier 111 can be moved upwards and downwards while maintaining its posture.

If the size and/or weight of the chandelier is much larger, it is desirable that three or more self-winding-type fixture-lifting/lowering devices 1 be used.

Figure 7:
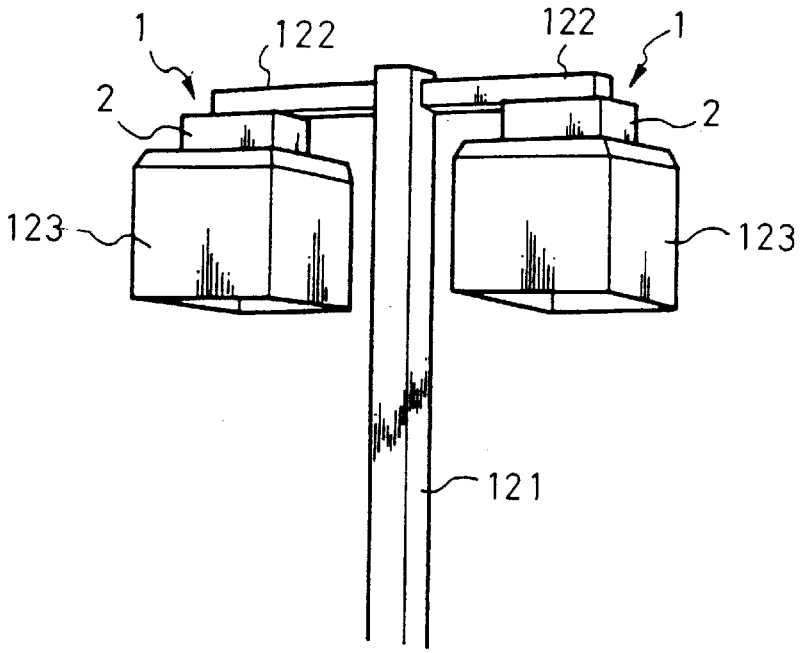
FIG. 7 shows a streetlight that can be fixed to a street pole by using an embodiment of the self-winding-type fixture-lifting/lowering device of the present invention.

FIG. 7 shows an application wherein the self winding-type fixture-lifting/lowering device 1 is used for fitting a street light. This figure depicts a street pole 121, a pair of arms 122 extending horizontally from the top end of the pole 121 in opposite directions to each other, and a pair of box-type lighting fixtures 123 supported by the arms 122, using a pair of self-winding-type fixture-lifting/lowering devices 1. As seen from the figure, both of the lighting fixtures 123 are fitted to the lower surfaces of the arms 122, so that the lighting fixtures 123 can be lowered to the floor level or to the top of a working table, thereby enabling a worker to do necessary maintenance work easily and safely.

Figure 8:
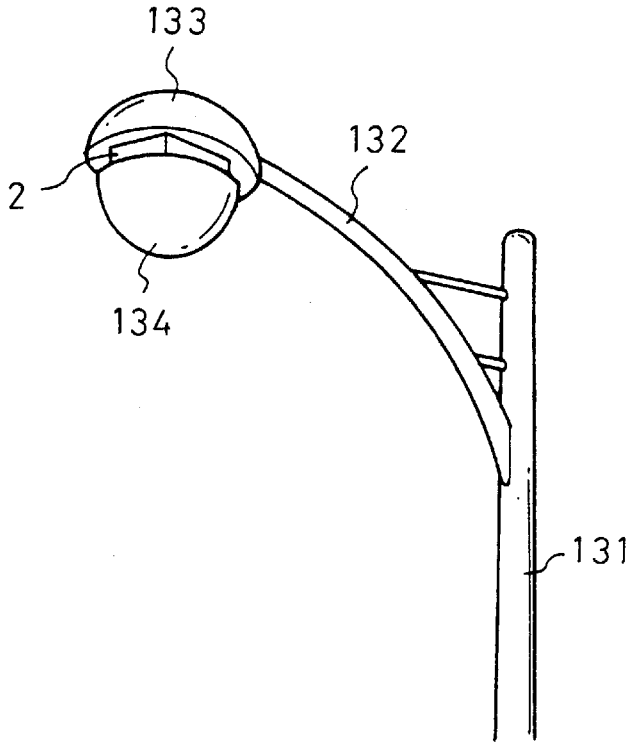
FIG. 8 shows an another type of streetlight that can be fixed to a street pole by using an embodiment of the self-winding-type fixture-lifting/lowering device of the present invention.

FIG. 8 shows an example of the self-winding-type fixture-lifting/lowering device that embodies the present invention being applied to install a ball-type lighting fixture. This figure depicts a street pole 131, a curved arm 132 extending from the top-end portion of the pole 131. To the proximal-end portion of the arm 132, a cover 133 is secured, and a ball-type lighting fixture 134 is fitted beneath said cover 133, using a self-winding-type fixture-lifting/lowering device 1.

In this example, similar to the above-mentioned applications, the only work that is necessary for installing the lighting fixture 134 is to fix a small and lightweight secure block 2 to the cover 133; accordingly, the installation work is simplified. Also, after the lighting fixture 134 has been installed, it is lowered when periodic maintenance is done or if it malfunctions, which thereby enables a worker to do necessary maintenance work easily and safely.

Figure 9:
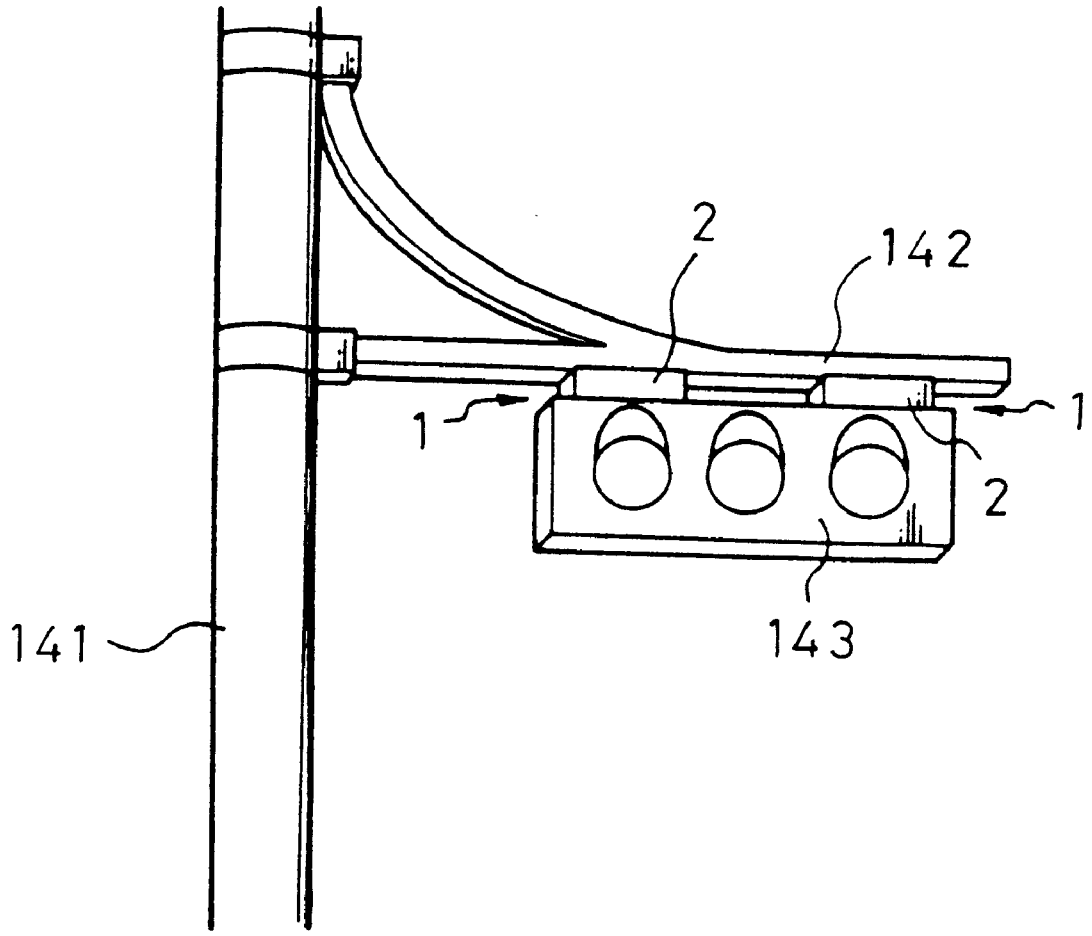
FIG. 9 shows a traffic-light device that can be fixed to a street pole by using an embodiment of the self-winding-type fixture-lifting/lowering device of the present invention.

FIG. 9 illustrates a case in which the self-winding-type fixture-lifting/lowering device 1 is applied in installing a traffic-signal device. FIG. 9 depicts a street pole 141, and an arm 142 extending horizontally from the top-end portion of the pole 141 at a suitable height. A traffic-signal device 143 is fitted on the lower surface of the arm 142.

In this application, the only work that is necessary for installing the traffic-signal device 143 is to fix a small and lightweight secure block 2 to the arm 142; accordingly, the installation work is simplified. After the traffic-signal device 143 has been installed, it is lowered at the time when periodic maintenance is done or if it malfunctions, which thereby enables a worker to do necessary maintenance work easily and safely.

What is claimed is:

1. A self-winding-type fixture-lifting/lowering device that is movable upwards and downwards, that is used for installing light fixtures and similar devices at an elevated position, and that comprises:

a secure block securely fixed at said elevated position;

a lifting/lowering block that hangs from said secure block by a pair of wire cables in such a manner as to be movable upwards and downwards and so as to support said light fixture or similar device;

with said lifting/lowering block carrying a pair of winding drums for winding and unwinding, respectively, said wire cables, an electric motor for driving said winding drums in synchronization with each other, and a battery for supplying electric power to said electric motor;

with each of said wire cables being secured to said lifting/lowering block at one end and connected to said winding drums and arranged so as to pass through a path formed on a first pulley fixed to said secure block, a second pulley disposed apart from said first pulley and fixed to said secure block, and a third pulley fixed to the lifting/lowering block;

a lock mechanism for locking said lifting/lowering block against said secure block; and a release mechanism for releasing said lock mechanism when said lifting/lowering block is to be moved downwards.

2. A self-winding-type fixture-lifting/lowering device as claimed in claim 1, wherein said secure block comprises an upper framework of substantially rectangular shape and said lifting/lowering block comprises a lower framework of substantially rectangular shape, with one end of each of said wire cables being secured at a fixing spot disposed at a corner portion of said lower framework, with said third pulley being positioned apart from said fixing spot in the widthwise direction of said lower framework, and with said first and second pulleys being positioned at points corresponding to said fixing spot and said third pulley.

3. A self-winding-type fixture-lifting/lowering device as claimed in claim 1, wherein said electric motor rotates in the direction so as to wind said wire cables when electric power is supplied and rotates in the reverse direction when electric power is not supplied.

4. A self-winding-type fixture-lifting/lowering device as claimed in claim 1, that further comprises a reduction mechanism that is inserted between the driving shaft of said electric motor and said winding drums.

5. A self-winding-type fixture-lifting/lowering device as claimed in claim 1, wherein said lock mechanism comprises at least one engaging member that is supported by said secure block so as to be swingable around a substantially horizontal axis and that is guided so as to rotate toward one end of the movable range thereof, and that has at least one engaging hole, at least one hook member to be engaged with said engaging hole of said engaging member fixed to said lifting/lowering block, and a lock-releasing mechanism for disengaging said engaging member from said hook member by rotating said engaging member.

6. A self-winding-type fixture-lifting/lowering device as claimed in claim 1, wherein said lock-releasing mechanism comprises a lever that is swingably fixed to said secure block and that, when rotated manually, disengages said locking member from said hook member by rotating said engaging member.

7. A self-winding-type fixture-lifting/lowering device as claimed in claim 1, wherein the fixture to be installed at an elevated position is a lighting fixture to be installed on a ceiling.

8. A self-winding-type fixture-lifting/lowering device as claimed in claim 1, wherein the fixture to be installed at an elevated position is a chandelier.

9. A self-winding-type fixture-lifting/lowering device as claimed in claim 1, wherein the fixture to be installed at an elevated position is a box-type lighting fixture.

10. A self-winding-type fixture-lifting/lowering device as claimed in claim 1, wherein the fixture to be installed at an elevated position is a ball-type street light.

11. A self-winding-type fixture-lifting/lowering device as claimed in claim 1, wherein the fixture to be installed at an elevated position is a ball-type traffic-signal device.

12. A self-winding-type fixture-lifting/lowering device that is movable upwards and downwards, that is used for installing light fixtures and similar devices at an elevated position, and that comprises:

a secure block securely fixed at said elevated position;

a lifting/lowering block that hangs from said secure block by a pair of wire cables in such a manner as to be movable upwards and downwards and so as to support said light fixture or similar device;

with said lifting/lowering block carrying a pair of winding drums for winding and unwinding, respectively, said wire cables, an electric motor for driving said winding drums in synchronization with each other, and a battery for supplying electric power to said electric motor;

with each of said wire cables being secured to said lifting/lowering block at one end and connected to said winding drums and arranged so as to pass through a path formed on a first pulley fixed to said secure block, a second pulley disposed apart from said first pulley and fixed to said secure block, and a third pulley fixed to the lifting/lowering block;

a locking means for locking said lifting/lowering block against said secure block; and a release mechanism for releasing said locking means when said lifting/lowering block is to be moved downwards.

13. A self-winding-type fixture-lifting/lowering device as claimed in claim 12, wherein said secure block comprises an upper framework of substantially rectangular shape and said lifting/lowering block comprises a lower framework of substantially rectangular shape, with one end of each of said wire cables being secured at a fixing spot disposed at a comer portion of said lower framework, with said third pulley being positioned apart from said fixing spot in the widthwise direction of said lower framework, and with said first and second pulleys being positioned at points corresponding to said fixing spot and said third pulley.

14. A self-winding-type fixture-lifting/lowering device as claimed in claim 12, wherein said electric motor rotates in the direction so as to wind said wire cables when electric power is supplied and rotates in the reverse direction when electric power is not supplied.

15. A self-winding-type fixture-lifting/lowering device as claimed in claim 12, that further comprises a reduction mechanism that is inserted between the driving shaft of said electric motor and said winding drums.

16. A self-winding-type fixture-lifting/lowering device as claimed in claim 12, wherein said locking means comprises at least one engaging member that is supported by said secure block so as to be swingable around a substantially horizontal axis and that is guided so as to rotate toward one end of the movable range thereof, and that has at least one engaging hole, at least one hook member to be engaged with said engaging hole of said engaging member fixed to said lifting/lowering block, and a lock-releasing mechanism for disengaging said engaging member from said hook member by rotating said engaging member.

17. A self-winding-type fixture-lifting/lowering device as claimed in claim 12, wherein the fixture to be installed at an elevated position is a lighting fixture to be installed on a ceiling.

18. A self-winding-type fixture-lifting/lowering device as claimed in claim 12, wherein the fixture to be installed at an elevated position is a chandelier.

* * * * *